US007095381B2

(12) United States Patent
Kimura et al.

(10) Patent No.: US 7,095,381 B2
(45) Date of Patent: Aug. 22, 2006

(54) ANTENNA COIL

(75) Inventors: Satoru Kimura, Turugashima (JP); Junichi Sato, Turugashima (JP); Hidehito Uchida, Yokohama (JP)

(73) Assignees: Toko Co., LTD, Turugashima (JP); Alpha Co., Ltd., Yokohama (JP)

( * ) Notice: Subject to any disclaimer, the term of this patent is extended or adjusted under 35 U.S.C. 154(b) by 0 days.

(21) Appl. No.: 11/034,911

(22) Filed: Jan. 12, 2005

(65) Prior Publication Data

US 2005/0219139 A1 Oct. 6, 2005

(30) Foreign Application Priority Data

Apr. 6, 2004 (JP) ..... 2004-111734

(51) Int. Cl.
*H01Q 7/08* (2006.01)

(52) U.S. Cl. ..... 343/788

(58) Field of Classification Search ..... 343/788, 343/787, 713, 742, 702, 867
See application file for complete search history.

(56) References Cited

U.S. PATENT DOCUMENTS 5,134,392 A * 7/1992 Takeuchi et al. ..... 340/5.62
6,400,330 B1 * 6/2002 Maruyama et al. ..... 343/788
6,577,558 B1 * 6/2003 Ricci ..... 368/228
6,976,726 B1 * 12/2005 Hirota et al. ..... 296/146.1
6,977,619 B1 * 12/2005 March et al. ..... 343/711
2003/0122712 A1 * 7/2003 Rawnick et al. ..... 343/700 MS

FOREIGN PATENT DOCUMENTS

JP 2001-115700 4/2001
JP 2001-358522 12/2001

* cited by examiner

*Primary Examiner*—Hoang V. Nguyen
*Assistant Examiner*—Huedung X. Cao
(74) *Attorney, Agent, or Firm*—Jordan and Hamburg LLP

(57) ABSTRACT

An antenna coil includes a bar-shaped core, a bobbin, a coil, a case, and a wiring harness. The bobbin is formed of insulating material and has the coil wound around the bobbin with the bar-shaped core within the bobbin. The case is formed of insulating material defining a cavity having a cavity interior wall. The bobbin with the coil wound there-around is disposed in the cavity. The case has a protrusion extending into the cavity. The wiring harness is connected to the coil and disposed around a portion of a perimeter of the protrusion in a substantially omega shape and is disposed at least in part between the protrusion and the cavity interior wall. A flexible resin fills spaces in the cavity between the bobbin and the cavity interior wall.

1 Claim, 3 Drawing Sheets

ANTENNA COIL

BACKGROUND OF THE INVENTION

This invention relates to a miniature antenna coil using an induction magnetic field to be utilized in a keyless entry device such as a door handle, a door mirror and the like in a vehicle.

As a conventional keyless entry device in a vehicle, a device in which a remote unit transmits radio waves with a prescribed code when an operator operates a button in a remote unit and locks or unlocks a door of the vehicle and when the code coincides with the specified code registered in the vehicle previously is common. Also, a device in which a door of the vehicle can be unlocked automatically only when a driver carrying a remote unit with him approaches the vehicle without operating a button and a door of the vehicle can be locked automatically when the driver gets out and leaves from the vehicle is known recently in this type of the device.

Referring to FIG. 3, a keyless entry device of the vehicle is provided with a first antenna coil 27 in a remote unit A side, a transmitter 28, and a control circuit 29 which transmits a prescribed signal to the transmitter 28 in response to an electric current from the first antenna coil 27. Radio waves are transmitted between the unit A and the vehicle to lock and unlock the door of the vehicle. Battery 30 supplies electric power to the transmitter 28 and the first control circuit. A second antenna coil 31 and a feeding circuit 32, which supplies electric power to the second antenna coil 31, transmit an electromagnetic wave for activation of the remote unit A, and a receiver 33 which receives the prescribed signal from the transmitter 28 are provided in the vehicle mounting side unit B. The receiver 33 controls the feeding circuit 32 to supply electric power to the second antenna coil 31. When the first antenna coil 27 is in a fixed range to the second antenna coil 31, that is to say, when the scope of magnetic field is within about 1 m from the second antenna coil 31, the electromagnetic wave for activation of the remote unit is coupled by electromagnetic inductive coupling with the first antenna coil 27. The device is also provided with the second control circuit 34, which locks and unlocks the door of the vehicle based on the prescribed signal from the receiver 33 and an automatic locking timer 35 and timer 36, a human body detection sensor 37 in the vehicle and a door lock device driving circuit 38 to drive the door lock device for locking and unlocking the door of the vehicle, which are attached on a portable item for carrying the remote unit A.

In this way, the second control circuit 34 controls the feeding circuit 32 to supply electric power to the second antenna coil 31 and to transmit the electromagnetic wave for activation of the remote unit. The first control circuit 29 activates the transmitter 28 to transmit the prescribed signal based on electric current from the first antenna coil 27, which received the electromagnetic wave for activation to activate the remote unit. And, the second control circuit 34 locks and unlocks the door of the vehicle based on the prescribed signal from the receiver 33 on a vehicle mounting side unit A, which received this prescribed signal. Accordingly, when the first antenna coil 27 is in a fixed range to the second antenna coil 31, the first control circuit 29 receives electric current from the first antenna coil 27 as an activation signal to activate the first control circuit 29 and activates the transmitter 28 for the first time receiving this signal. After the transmitter 28 is activated, a battery 30 in a remote unit A is used only for the stand-by power necessary for stand-by to receive electric power from the first antenna coil 27 in the first control circuit 29 and so the consumption of the battery 30 can be reduced. The keyless entry device is carried by attaching the remote unit A on the portable item. And this keyless entry device is disclosed in a Patent Document 1.

The second antenna coil 31 on the vehicle mounting side is usually attached at the handle of the doorknob in the conventional keyless entry device in the vehicle.

An antenna coil using a bar antenna attached on a door handle is disclosed in a Patent Document 2 as an antenna coil for keyless entry. The disclosed antenna coil has a single core made of thin bar-shaped ferromagnetic substance with a winding. The core and a bobbin wrapping the core are contained in a storing case and an opening between the core and the bobbin and the opening between the bobbin and the case are filled with potting material to prevent damage of the single core unit and deterioration by temperature, humidity and the like.

[Patent Document 1] JP2001-115700 Publication of unexamined patent applications

[Patent Document 2] JP2001-358522 Publication of unexamined patent applications

SUMMARY OF THE INVENTION

An antenna coil in a keyless entry device for a vehicle is installed on a handle and the like in particular in order to be attached to a doorknob, a door mirror and the like as explained above, for which high reliability on external connection, etc. and miniaturization and also environmental performance for shock, vibration and temperature, humidity are required.

This invention provides an antenna for use as the second antenna coil 31 in Patent Document 1 and the purpose is to provide an antenna coil with simplicity in structure, cheapness and miniature, which is reliable and satisfies the above described requirements.

In order to solve above described problems, the antenna coil relating to this invention is provided with a thin bar-shaped core, a flat, recessed and insulated bobbin of which one side is open, and an insulated exterior case, with a recessed cross section on one side which is bigger than the bobbin and is open. The core is disposed in a recessed part of the bobbin, and is provided with a coil having a winding provided on a winding groove formed in the bobbin. The coil assembly is disposed in a recessed part of the exterior case which is filled with adhesive made of resin with high flexibility.

Also, a circuit pattern, to which a tuning condenser and a harness for external connection are connected electrically, is installed on the bobbin at the end of the longitudinal direction of the bobbin.

In addition, a protruded part of the case is provided around which a harness, for external connection to the circuit pattern, is disposed in an almost Ω-like shape and extended out to outside of the exterior case.

The antenna coil relating to this invention is provided with the structure and means described above and displays the following effects. Since the core is stored in a recessed part of the bobbin, the coil is dispersed in a winding groove formed in the bobbin, and the bobbin is stored in a recessed part of the exterior case filled with adhesive made of resin with high flexibility. A structure in which the sealed coil and core are disposed is thereby formed which is protected from deteriorating factors such as temperature, humidity, shock, vibration and the like. Also, there is an effect to enable stabilized transmission and reception annulling the changes in inductance by length of the harness as the circuit pattern is prepared in the bobbin and the tuning condenser and the harness for external connection are connected electrically.

In addition, as the harness is inserted along the side of the protruded part of the exterior case and the inner wall of the exterior case, and the shape is formed Ω-like, detachment of the harness can be prevented. In this way, the antenna coil in this invention has an effect to realize a cheap and miniature type antenna coil, which has a built-in tuning condenser, prevents detachment of the harness, and can be sealed by the adhesive made of resin with high flexibility in the recessed part of the exterior case. The manufacturing method is easy and the structure is simple and the reliability on external connection is enhanced.

BRIEF DESCRIPTION OF THE DRAWINGS

The objects and features of the invention will become apparent from the following description taken in conjunction with the preferred embodiment thereof with reference to the accompanying drawings in which.

DETAILED DESCRIPTION OF THE PREFERRED EMBODIMENT

An antenna coil of this invention is provided with a core made of thin, bar-shaped ferrite, disposed in a flat, recessed and insulated bobbin of which one side is open. A winding groove is formed in the bobbin and has a coil part, which connects with a tuning condenser and a harness for external connection electrically. A circuit pattern is prepared at an end of the longitudinal direction of the bobbin. The bobbin is stored in an insulated exterior case with a recessed cross section on one side which is open. The harness is disposed almost Ω like along the protruded part and the inner wall of the case and drawn out to the outside and spaces between the core and the bobbin and between the winding part and the inner wall of the exterior case are sealed using an adhesive of resin with high flexibility.

Hereinafter, a working example of the antenna coil or this invention is explained according to the attached drawings.

The antenna coil relating to this invention corresponds in use to the second antenna coil 31 in Patent Document 1, which transmits the electromagnetic wave for activation of the remote unit by inductive coupling with the first antenna coil 27 when the first antenna coil 27 is in a fixed range to the second antenna coil 31, that is to say, when the scope of magnetic field is within about 1 m from the second antenna coil 31. The operating frequency is 125 KHz.

Figure 1:
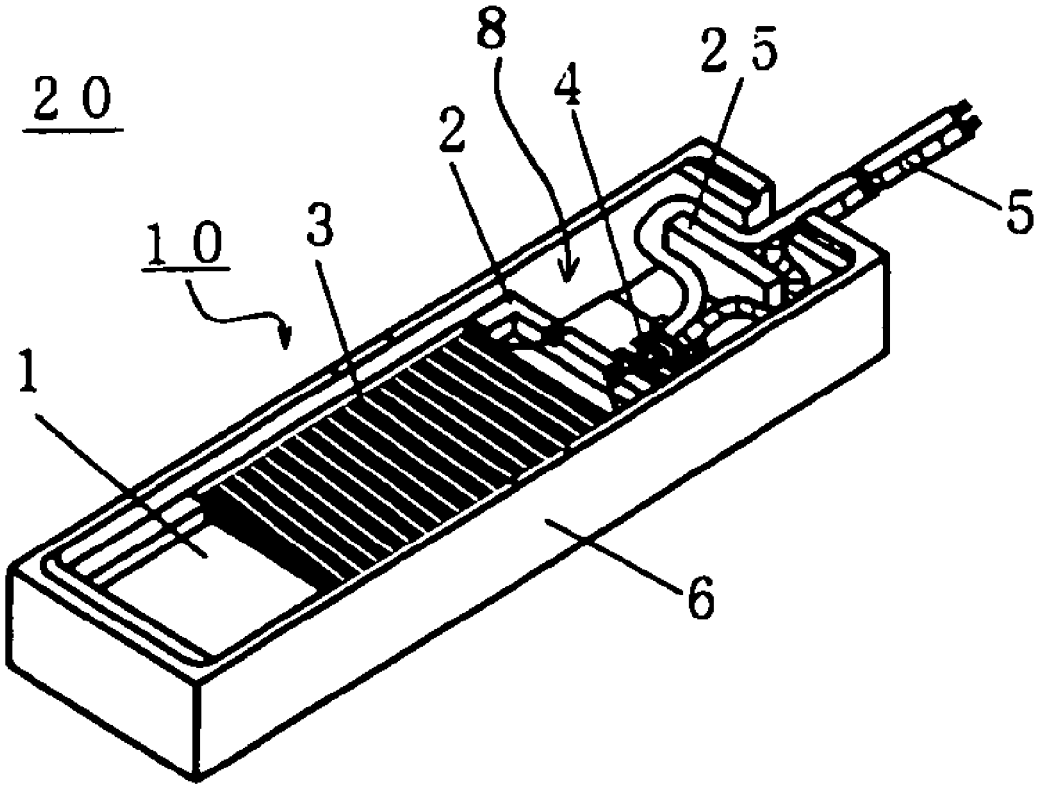
FIG. 1 is a perspective view showing an antenna coil relating to this invention.
Figure 2:
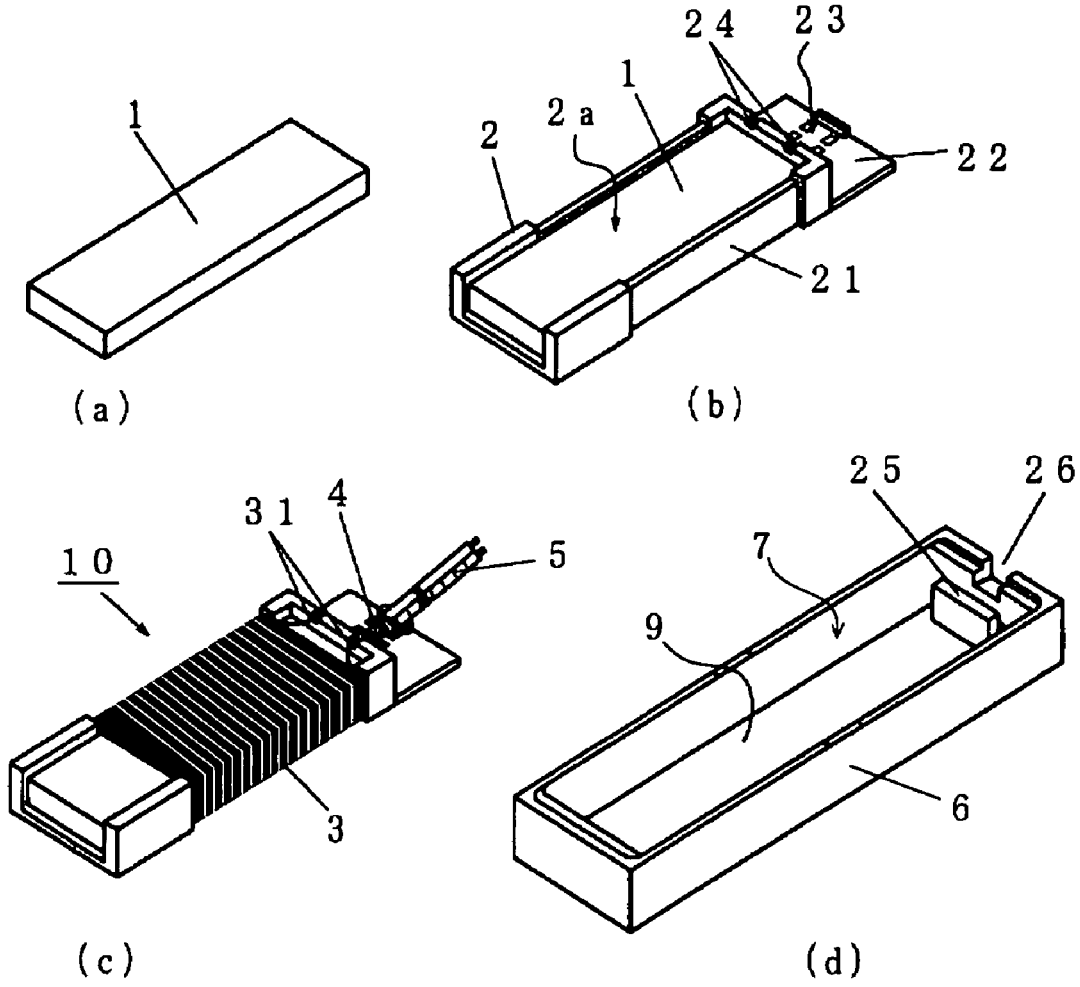
FIG. 2 is an exploded view showing the antenna coil relating to this invention and (a) is a perspective view of the core, (b) is a perspective view of the bobbin in which the core is stored, (c) is a perspective view of the coil of which winding groove is wounded and (d) is a perspective view of an the exterior case.
Figure 3:
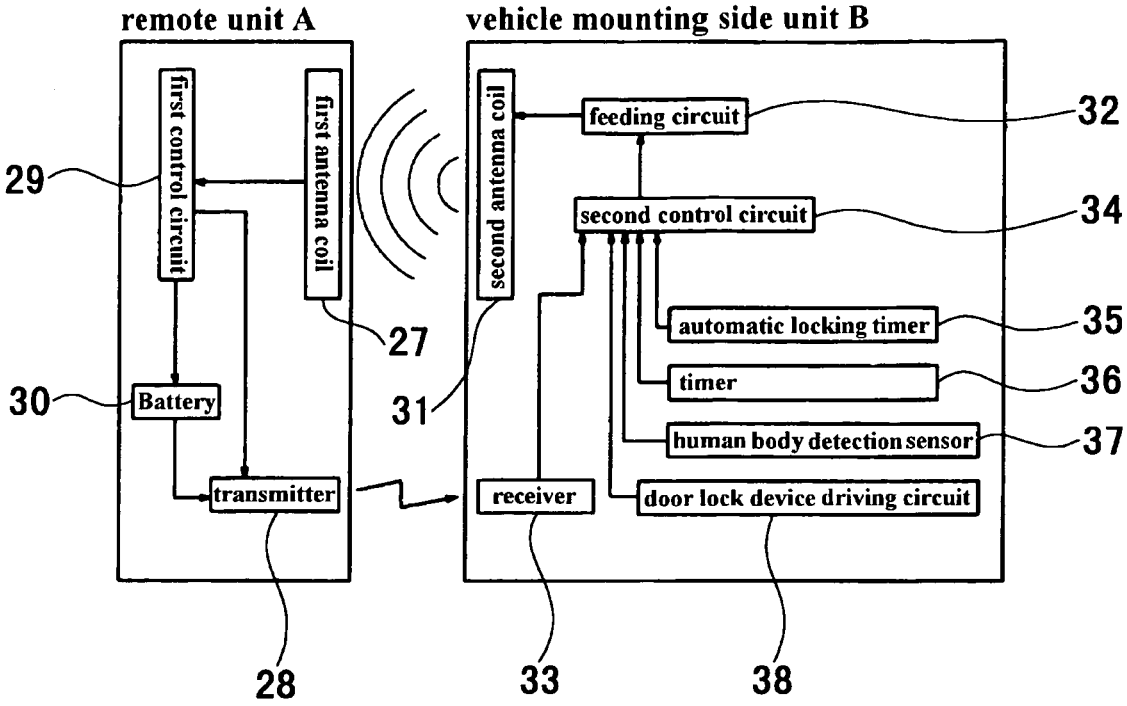
FIG. 3 is a block diagram of the keyless entry device of the vehicle in prior art.

FIG. 1 shows a perspective view of the antenna coil relating to one mode of working in this invention. FIG. 2 shows a perspective decomposition view of the antenna coil shown in FIG. 1.

The antenna coil 20 is shown in FIG. 1 and FIG. 2. The core 1 is formed with thin, flat ferromagnetic substance as shown in FIG. 2(*a*). The core 1 is stored in a recessed part 2*a* of a bobbin 2 formed with insulated heat proof resin as shown in FIG. 2(*b*). The core 1 and the bobbin 2 may be fixed temporarily using the adhesive. And an insulated and coated wire is wound on a winding groove 21 of the bobbin 2 to make a winding 3 forming a coil. As shown in FIG. 2(*c*), a lead 31 of the winding 3 (second antenna coil) is connected electrically to a circuit pattern 23 prepared in an extension part 22 in one side of the bobbin 2 by means of soldering and the like along a wiring groove 24 prepared in the bobbin 2. Tuning condenser 4 and the harness for external connection 5 are connected on the circuit pattern 23 electrically by means of soldering and the like to form a coil assembly 10.

Exterior case 6 is a case made of insulated resin with a recessed cross section on one side, which is bigger than a bobbin 2 and is open as shown in FIG. 2(*d*). Wiring groove 26 is prepared in one short side of an opening face 7 and protruded part 25 is prepared inside or the wiring groove 26.

As shown in FIG. 1, the coil assembly 10 is stored in a recessed part 9 in the exterior case 6, which is bigger than the bobbin 2, and the harness 5 is in an almost Ω-like shape and held with the side of the protruded part 25 and the inner wall of a long side of the exterior case and is drawn out along the wiring groove 26 in the antenna coil 20. In this way, the antenna coil is formed with high reliability in which no influence is given on the connected part with the circuit pattern 23 even when a pulling power is applied from the outside by drawing out the harness 5.

An adhesive is injected from the opening 7 of the exterior case 6 in which the coil assembly 10 is stored, to reach the upper face of the opening 7 to permeated in the winding 3 and bobbin 2 and fill in a space between the bobbin 2 and the inner wall of the exterior case 6 and is cured in the antenna coil 20.

In this way, the antenna coil 20 relating to this invention is suitable for vibration, shock or environmental features such as temperature, humidity and the like by filling the adhesive inside of the coil 10 and the space between the coil 10 and the exterior case 6 with adhesive. In addition, a thin and flat lid made of resin may be installed as the need arises, though it is not illustrated.

It is desirable for the core 1 to the high strength, high magnetic permeability Mn/Zn system ferrite with excellent pressure characteristics, Ni/Zn system ferrite or amorphous magnetic substance and the like. The thin bar-shape rather than a round shape is desirable as a shape when taking the mounting into consideration. The relative permeability of the core 1 is made to be over 1,000, so that the change in sensitivity by dispersion of the relative permeability can be lessened. The optimum condition of 10 mm long, 5 mm wide and 3 mm thick was deduced as a dimension of the core 1 to be minimum in shape in the antenna coil in the working example.

It is desirable for the bobbin 2 and the exterior case 6 to use a material with insulation-resistance, heat-proof, chemical-resistance or water-proof characteristics, for example, heat-proof ABS and the like. The circuit pattern 5 prepared in the bobbin may be one in which a lead-frame, etc. is buried simultaneously in casting the bobbin, or one in which common printed substrates are glued.

Adhesive 8 should have a function to fix the core 1, the winding 3 and the bobbin 2, fill spaces within the inner wall of the exterior case 6 and be a structure in which the scaled coil assembly 10 is protected from the deteriorating factors in environmental performances such as temperature, humidity, shock, vibration and the like. Also, the adhesive 8 may be the a material full of flexibility and apply less pressure on core 1 in hardening. A urethane system resin which functions to absorb shock and vibration, is insulation resistant, chemical resistant and water-proof is preferable.

In this way, the inventor repeats various examinations on the antenna coil 20 relating to this invention and tries to obtain the optimum conditions for the core 1 to be the smallest, considering the magnetic permeability and winding (inductance) of the core 1 for transmitting the electromagnetic wave to activate the remote unit by electromagnetic inductive coupling. The scope of magnetic field is to be within the scope of about 1 m from the antenna coil. This is determined by analysis of the electromagnetic field in order to satisfy electric requirement feature and the miniaturization.

Core 1 is formed with thin bar-shaped ferrite and the core 1 is stored in a flat, recessed and insulated bobbin 2 of which one side is open. The winding 3 is provided on a winding groove 21 formed in a bobbin 2. Coil assembly 10, in which a tuning condenser 4 and the harness for external connection 5 are connected electrically on the circuit pattern 23 prepared at one end part of the bobbin 2, is stored in the insulated exterior case 6 with the recessed cross section on one side which is open. Harness 5 is disposed almost in an O-like shape between protruded part 25 prepared inside of the exterior case 6 and inner wall of the case and is drawn out to the outside. Accordingly, the antenna coil 20 with high reliability in which no influence is given on to the connected part with the circuit pattern 23 by the harness 5 through a pulling power from the outside, can be made.

In addition, it is a suitable one for vibration, shock or environmental features such as temperature, humidity and the like by sealing the space between the core 1 and the bobbin 2 and the space between the winding 3 and inner wall of the exterior case 6 with the adhesive 8 made of resin with high flexibility.

As one side is open in both of the bobbin 2 and the exterior case 6, the storing works of the core 1 and the bobbin 2, and the coil 10 and the exterior case 6 is easy, the injection of the adhesive 8 is easy, the drying is easy and a cheap and miniature type antenna coil simple structure to improve the working performance can be made.

The invention claimed is:

1. An antenna coil comprising:

a bar-shaped core;

a bobbin formed of insulating material and having opposing first and second ends, opposing longitudinal sides extending between said first and second ends and defining a side opening of a recess therebetween, said opposing longitudinal sides defining a winding accepting groove, and said bar-shaped core being disposed in said recess;

a coil wound around said bobbin and said bar-shaped core within said winding accepting groove;

a case formed of insulating material defining a cavity having a cavity interior wall, said bobbin with said coil wound therearound being disposed in said cavity;

a tuning condenser connected to said coil and situated proximate said first end;

said case having a protrusion extending into said cavity;

a wiring harness connected to said tuning condenser and extending exterior of said case, said wiring harness being disposed around a portion of a perimeter of said protrusion in a substantially omega shape, said wiring harness being disposed at least in part between said protrusion and said cavity interior wall; and a flexible resin filing spaces in said cavity between said bobbin and said cavity interior wall.

* * * * *